US006533562B1

(12) United States Patent
Sun

(10) Patent No.: US 6,533,562 B1
(45) Date of Patent: Mar. 18, 2003

(54) TWO-STAGE OIL INJECTION INTO SCROLL COMPRESSORS

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/978,402

(22) Filed: Oct. 16, 2001

(51) Int. Cl.[7] ..... F01C 1/02

(52) U.S. Cl. ..... 418/55.6; 418/99; 418/100; 418/270; 417/214; 417/310; 184/6.18; 184/103.1; 138/46

(58) Field of Search ..... 418/55.6, 99, 270, 418/100; 138/46; 184/6.18, 103.1; 417/310, 214

(56) References Cited

U.S. PATENT DOCUMENTS 5,169,294 A * 12/1992 Barito ..... 417/310
5,688,109 A * 11/1997 Matsuura et al. ..... 184/103.1
6,017,205 A * 1/2000 Weatherston et al. ..... 418/55.6
6,280,146 B1 * 8/2001 Bush et al. ..... 417/13
6,322,339 B1 * 11/2001 Mitsunaga et al. ..... 418/100
6,341,945 B1 * 1/2002 Hugenroth et al. ..... 417/214

FOREIGN PATENT DOCUMENTS

JP 60-030494 * 2/1985 ..... 418/100

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

An improved scroll compressor has condition responsive lubricant volume flow. The lubricant is preferably delivered to a tap positioned adjacent the suction chamber such that lubricant is delivered into the scroll compressor in a quantity which is desirable for normal operation of the scroll compressor. A valve is associated with the tap, and restricts the flow of lubricant through the tap to a first more restrictive non-actuated position. If operational conditions within the scroll compressor indicate that a greater lubricant flow would be desirable, the valve moves to an actuated position at which it is less restrictive to the flow of lubricant.

11 Claims, 3 Drawing Sheets

TWO-STAGE OIL INJECTION INTO SCROLL COMPRESSORS

BACKGROUND OF THE INVENTION

This invention relates to a scroll compressor having a controlled oil injection wherein the amount of oil injected between the scroll members is increased under certain operational conditions.

Scroll compressors are becoming widely utilized in refrigerant applications. In a scroll compressor, a first scroll member has a base and a generally spiral wrap extending from its base. The second scroll member has a base with a generally spiral wrap extending from its base. The wraps of the two scroll members interfit to define compression chambers. The second scroll member is caused to orbit relative to the first scroll member, and during this orbiting movement, the compression chambers decrease in volume, comprising an entrapped refrigerant.

The tips of the wraps of each of the scroll members are in contact with the base of the opposed scroll member during this movement. Further, there are other relatively moving surfaces on the scroll members. It is known to supply lubricant to the scroll members to lubricate the interface between the tips and the base, and other surfaces.

In one successful method, lubricant is driven into a suction chamber positioned radially outwardly of the scroll wraps, and is entrained in the refrigerant moving through the scroll compressor. The volume flow of refrigerant typically entrains a particular amount of lubricant. The amount of lubricant reaching the scroll member surfaces is typically dependent on the volume flow of refrigerant.

As an example, a typical lubricant flow of approximately 1% per volume of refrigerant is standard during normal operational conditions of a scroll compressor. Various ways have been developed to inject oil into the compression chambers, and the size of the flow passages, restrictions, etc. are selected to achieve an acceptable amount of lubricant during this normal operation.

Scroll compressors are subject to some operational challenges. As an example, if there is a lower than expected amount of refrigerant in the system, a so-called loss of charge situation, then the volume of refrigerant moving through the scroll compressor is less than expected or desired.

Other challenges relate to so-called "reverse running" condition. In one type of reverse running condition, the motor for the scroll compressor may be improperly wired if it is a three-phase powered motor. When this occurs, the second scroll member is caused to orbit in an opposed and undesired direction. Again, the volume of refrigerant flowing through the compressor will be much less than expected.

In such situations, the challenges on the relatively moving surfaces between the scroll member are even greater than normal. Temperatures are higher than would be expected, and providing an acceptable amount of lubricant becomes even more important. However, in a loss of charge situation, or reverse rotation, the volume flow is undesirably low and the percentage of lubricant entrained by the refrigerant will also be less than even normally supplied.

Thus, it would be desirable to develop a method of lubricating the sliding surfaces on the scroll members in such a fashion that additional lubricant is supplied under certain operational conditions.

SUMMARY OF THE INVENTION

In the disclosed embodiment of this invention, a condition responsive valve is positioned in a lubricant supply passage.

The condition responsive valve is maintained in a first relatively closed position under normal operating conditions. However, should conditions in the compressor indicate an operational challenge, the valve can open, allowing increased flow of lubricant. In a disclosed embodiment, the valve is temperature responsive to move between two positions. In a most preferred embodiment, the valve is located to restrict, but allow flow through a lubricant supply passage under normal conditions. If the valve senses a temperature above a predetermined maximum, then the valve moves to a second position at which it is less restrictive to the flow of lubricant.

In preferred embodiments, the valve is positioned in the non-orbiting scroll, and includes a bi-metal element which snaps between two positions to allow the valve to move to the two positions, as described above. In further embodiments, a spring may bias the valve to its normal position, and the bi-metal snap element moves against the force of the spring to allow the valve to move to its less-restrictive position.

These and other features of the present invention can be best understood from the following specification and drawings, the following of which is a brief description.

DETAILED DESCRIPTION OF A PREFERRED EMBODIMENT

Figure 1:
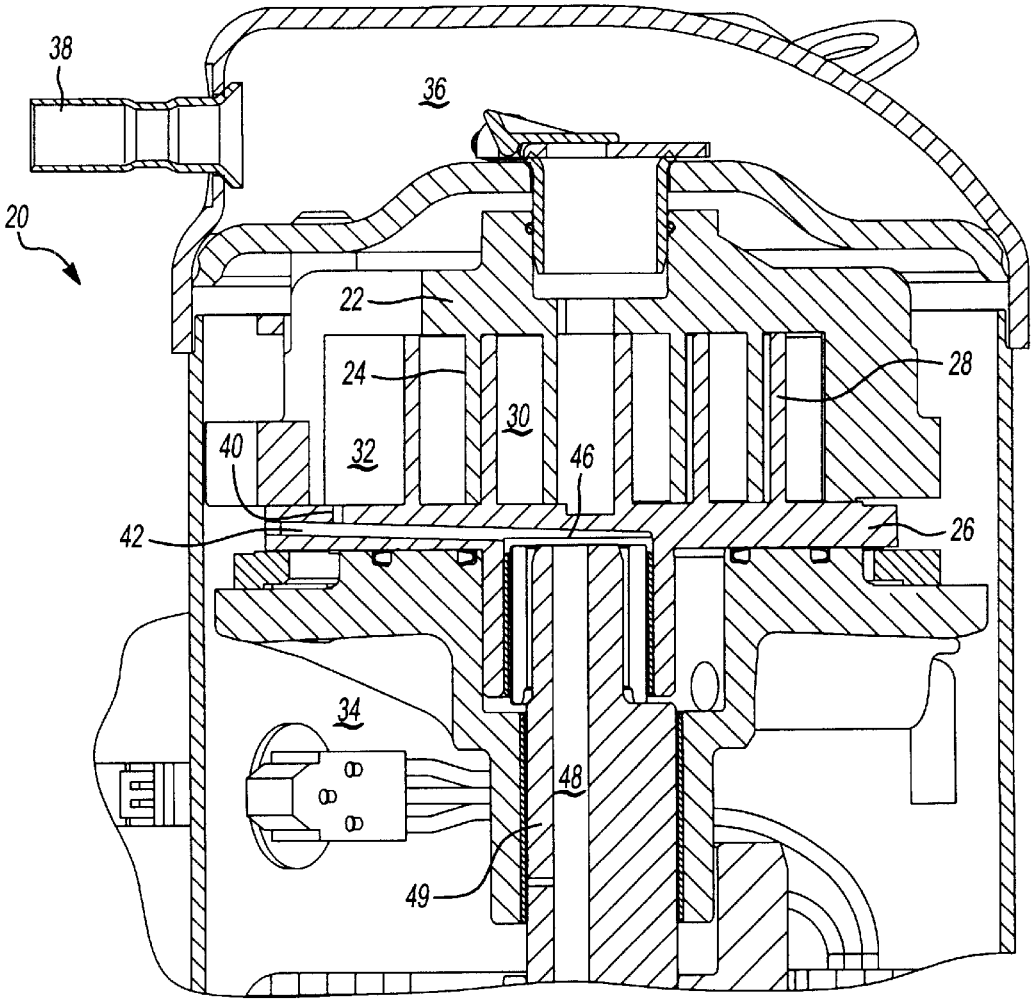
Fig-1 PRIOR ART
FIG. 1 shows a prior art scroll compressor.

FIG. 1 shows a known scroll compressor 20. A non-orbiting scroll 22 has a spiral wrap 24 and an orbiting scroll 26 has a wrap 28. As known the wraps interfit to define compression chambers 30. A suction chamber 32 is positioned radially outwardly of the wraps and communicates with suction pressure chamber 34. Refrigerant is compressed in the chambers 30, and delivered to a discharge chamber 36. From discharge chamber 36, the compressed refrigerant is delivered to a discharge tube 38 to a downstream use.

A tap 40 communicates with a passage 42 to in turn communicate with a bearing hub lubricant chamber 46 which receives lubricant from a lubricant passage 48 in a shaft 49. Lubricant passes through passage 48 into chamber 46, passage 42, and outwardly to tap 40 into a chamber 32. This lubricant is entrained with the suction refrigerant being compressed, and assists in ensuring adequate operation of the scroll compressor such as by lubricating the surfaces between the tips of the scroll wraps and the opposed base.

As mentioned above, the amount of lubricant reaching the compression chambers is dependent upon the volume flow of refrigerant. Under certain operational conditions the volume flow of refrigerant may be lower than expected.

Figure 2A:
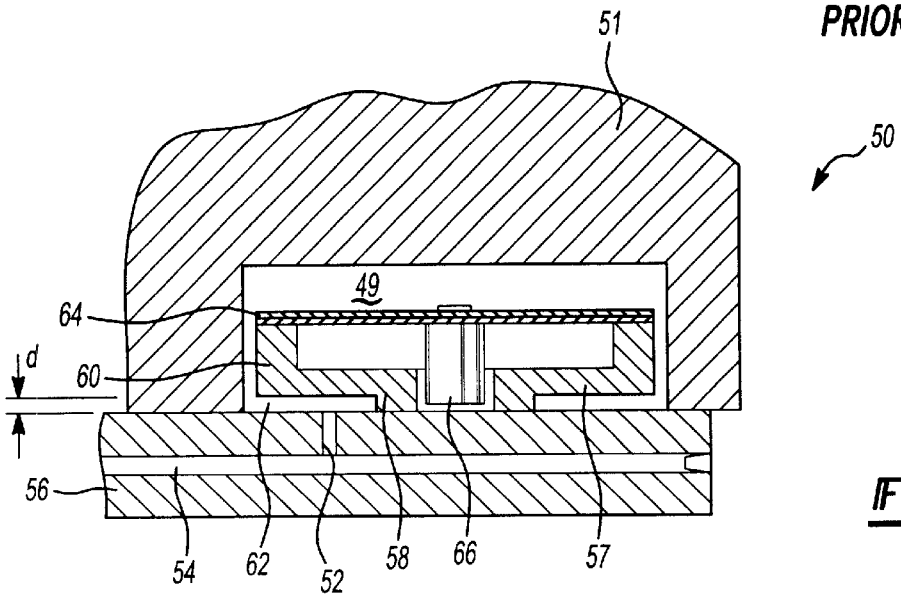
FIG. 2A shows a first embodiment of the present invention.
Figure 2B:
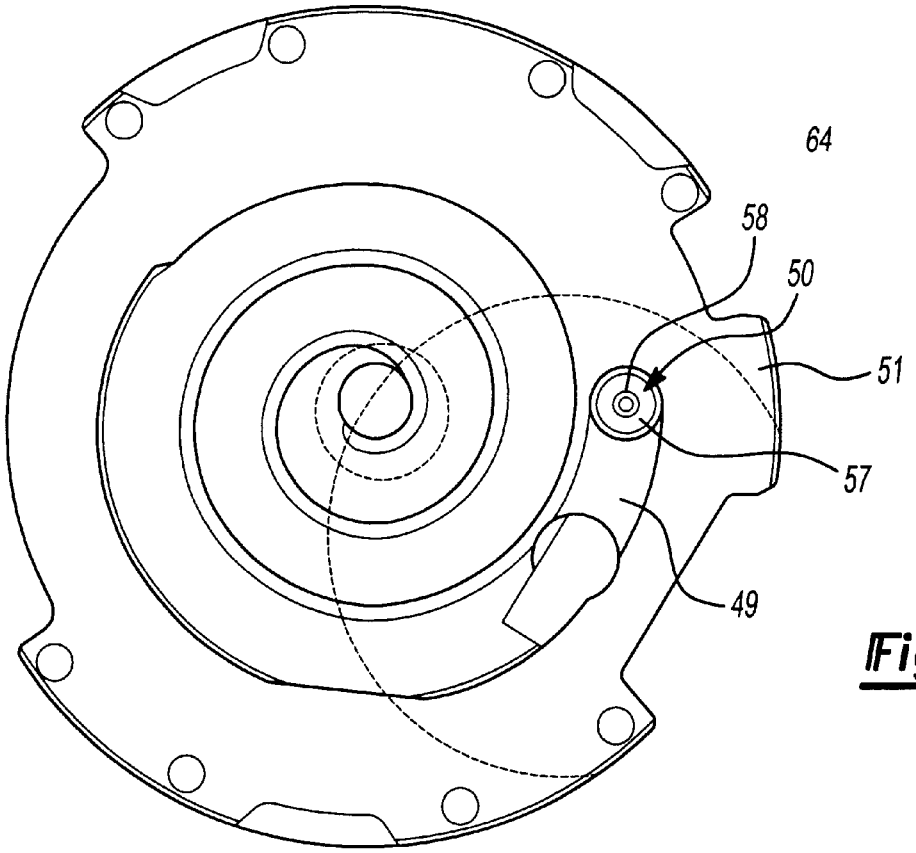
FIG. 2B is a top view of a portion of the FIG. 2A embodiment.

FIG. 2A shows the first embodiment 50 of the present invention. The non-orbiting scroll 51 is provided with a pocket 49 positioned adjacent the tap 52 for lubricant which communicates with the passage 54 found in the orbiting scroll 56. A valve 57 body includes a stop boss surface 58 having a radially outward metering surface 60 positioned to be spaced by an amount 62 from the tap 52. As shown, the space 60 allows flow of lubricant from the tap 52 into a chamber 49 through a distance d. However, as is also appreciated, there would be significant restriction on the flow through the tap 52 in this position.

A bi-metal snap element 64 is shown in its relaxed position. Such elements are known and move between a normal position to an actuated position when a target temperature is reached. A pin 66 is connected to the center of element 64, and with element 64. Element 64 is connected at its outer periphery to body 57.

Figure 2C:
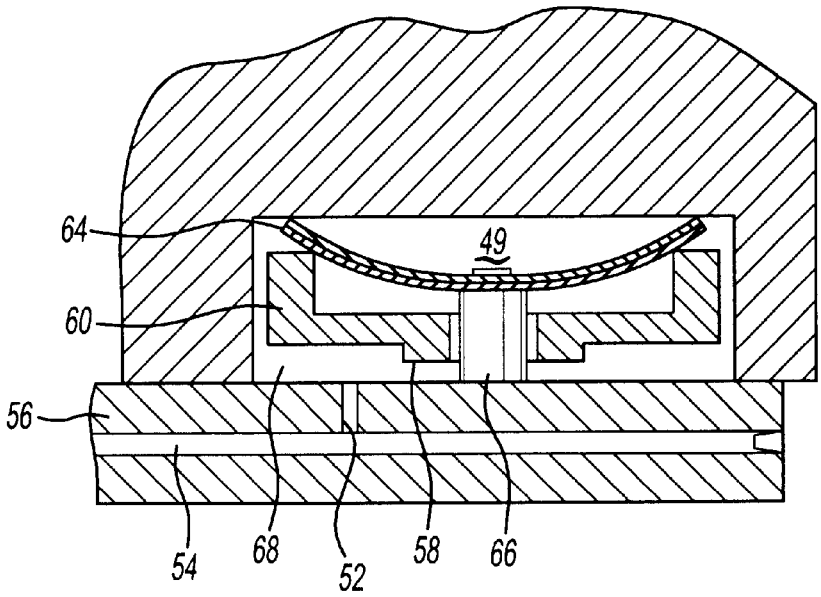
FIG. 2C shows the first embodiment having moved to an actuated position.

Should there be a loss of charge situation, reverse run situation, or other situation which may result in excessive temperatures in the scroll compressor set, then bi-metal element 64 will likely reach its trigger temperature. As shown, once its trigger temperature is reached, its "snaps" to its second position such as shown in FIG. 2C. In this position, the pin 66 is caused to abut the surface of the orbiting scroll 56, and force the boss surface 58 away from the orbiting scroll, and further force the surfaces 60 further away from the orbiting scroll. Now, there is much less restriction to flow of lubricant through the tap 52 into the chamber 49.

With this embodiment, should the temperature within the scroll compressor exceed a predetermined maximum, and which is selected to be indicative of a operational challenge within the scroll compressor, then the bi-metal element 64 snaps to its actuated position. There is then less restriction to the flow of lubricant into the chamber 49. In this way, more lubricant will flow per volume of refrigerant to the scroll compressor set. Since the volume flow of refrigerant is likely less, this will still ensure a greater amount of lubricant being delivered to the scroll members under these challenging conditions.

Figure 3A:
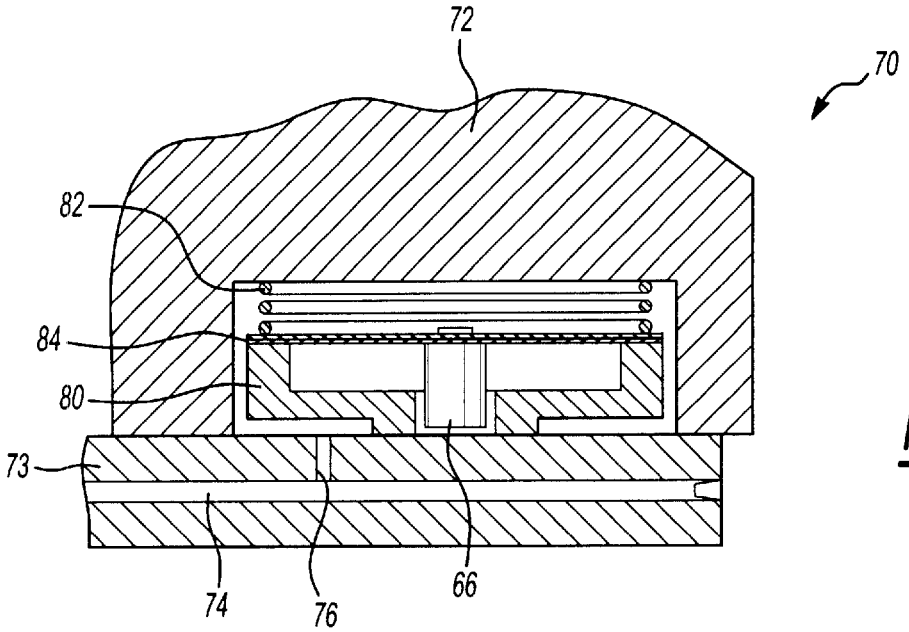
FIG. 3A shows a second embodiment.
Figure 3B:
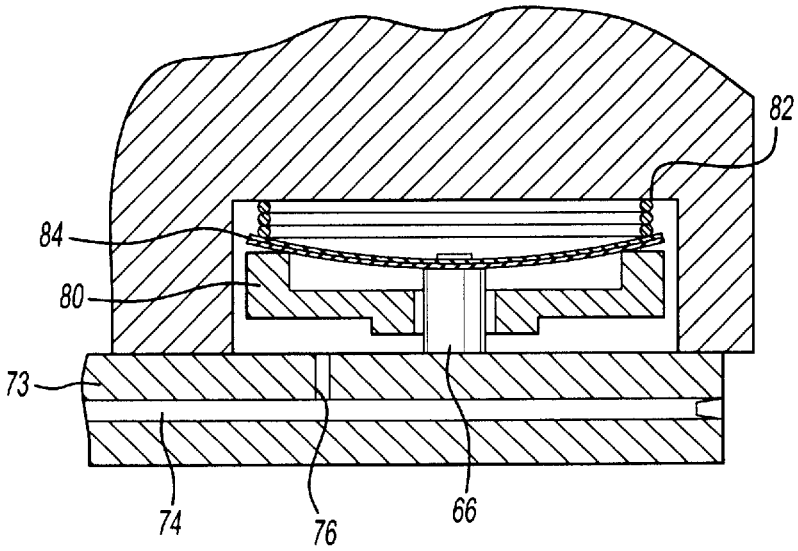
FIG. 3B shows the second embodiment having moved to its actuated position.

FIG. 3A shows another embodiment 70. Non-orbiting scroll 72 is positioned adjacent the orbiting scroll 73. Again, a passage 74 and tap 76 provide lubricant to a chamber within the non-orbiting scroll 72. A bi-metal element 84 is associated with the piston body 80, and carries a pin 66. In this embodiment, a spring 82 biases the piston body 80 to a position such as shown in FIG. 3A. In this restricted position, the spring 82 holds the piston body. Once the trigger temperature is reached, the bi-metal elements 84 stamps to its actuated position, and the piston body 80 moves away from the tap 76. Again, there is less restriction to flow of refrigerant.

Although preferred embodiments of this invention have been disclosed, a worker in this art would recognize that modifications would come within the scope of this invention. For that reason the following claims should be studied to determine the true scope and content of this invention.

What is claimed is:

1. A scroll compressor comprising:

a first scroll member having a base and a generally spiral wrap extending from its base;

a second scroll member having a base and a generally spiral wrap extending from its base, said wraps of said first and second scroll members interfitting to define compression chambers, and said second scroll member being driven to orbit relative to said first scroll member;

an oil supply for supplying a quantity of oil to a suction chamber positioned radially outwardly in at least one of said first and second scroll members, said oil supply including a passage extending through said second scroll member and a condition responsive valve for selectively controlling the amount of oil delivered into said suction chamber dependent on operational conditions in said scroll compressor, said condition responsive valve being positioned adjacent said passage such that said valve selectively allows a more restrictive and less restrictive flow of lubricant through such passage into said suction chamber.

2. A scroll compressor as recited in claim 1, wherein said valve is movable between a non-actuated position at which it restricts the flow of lubricant into said suction passage, and to an actuated position at which it is less restrictive to the flow of lubricant into said suction passage.

3. A scroll compressor as recited in claim 2, wherein said valve is positioned within a chamber in said first scroll member.

4. A scroll compressor as recited in claim 3, wherein said valve includes a bi-metal element which moves between an actuated and a non-actuated position to cause said valve to move between its actuated and non-actuated position.

5. A scroll compressor as recited in claim 4, wherein said bi-metal element is connected to a pin which is selectively forced against said second scroll member when said bi-metal element is moved to said actuated position.

6. A scroll compressor as recited in claim 5, wherein a spring biases said valve to said non-actuated position, and said bi-metal element moves in opposition to the force of said spring.

7. A scroll compressor comprising:

a first scroll member having a base and a generally spiral wrap extending from its base;

a second scroll member having a base and a generally spiral wrap extending from its base, said wraps of said first and second scroll members interfitting to define compression chambers, and said second scroll member being driven to orbit relative to said first scroll member;

an oil supply for supplying a quantity of oil to a suction chamber positioned radially outwardly in at least one of said first and second scroll members, and a condition responsive valve for selectively controlling the amount of oil delivered into said suction chamber dependent on operational conditions in said scroll compressor;

said valve being movable between a non-actuated position at which it restricts the flow of lubricant into said suction passage, and to an actuated position at which it is less restrictive to the flow of lubricant into said suction passage; and a piston associated with said valve has a boss of a greater thickness which selectively engages said second scroll member and a clearance portion positioned to have a lesser thickness and which is associated with a lubricant tap, said clearance portion being aligned with said tap when said boss contacts said second scroll member such that said valve is in said first more restrictive position, and said boss being moved away from said second scroll member, and said clearance portion being moved further away from said tap when said valve moves to said actuated position.

8. A scroll compressor comprising:

a first scroll member having a base and a generally spiral wrap extending from its base;

a second scroll member having a base and a generally spiral wrap extending from its base, said wraps of said first and second scroll members interfitting to define compression chambers, and said second scroll member being driven to orbit relative to said first scroll member; and an oil supply for supplying a quantity of oil through a passage in said second scroll member to a tap extending into a suction chamber positioned radially outwardly of said wrap on said first scroll member, a conditioned responsive valve having a bi-metal element which snaps between an actuated and a non-actuated position dependent on temperature, said valve restricting the flow of lubricant through said tap into said suction chamber when in said non-actuated position, and moving to a less restrictive position in said actuated position.

9. A scroll compressor as recited in claim 8, wherein said bi-metal element is connected to a pin which is selectively forced against said second scroll member when said bi-metal element is moved to said actuated position.

10. A scroll compressor as recited in claim 9, wherein a spring biases said valve to said non-actuated position, and said bi-metal element moves in opposition to the force of said spring.

11. A scroll compressor as recited in claim 8, wherein a piston associated with said valve has a boss of a greater thickness which selectively engages said second scroll member and a clearance portion positioned to have a lesser thickness and which is associated with a lubricant tap, said clearance portion being aligned with said tap when said boss contacts said second scroll member such that said valve is in said first more restrictive position, and said boss being moved away from said second scroll member, and said clearance portion being moved further away from said tap when said valve moves to said actuated position.

* * * * *